US007958658B2

(12) United States Patent
Fang

(10) Patent No.: US 7,958,658 B2
(45) Date of Patent: Jun. 14, 2011

(54) RECORDABLE CARD HOLDER UNIT

(76) Inventor: Jianping Fang, Lakewood, CA (US)

( * ) Notice: Subject to any disclaimer, the term of this patent is extended or adjusted under 35 U.S.C. 154(b) by 87 days.

(21) Appl. No.: 12/228,214

(22) Filed: Aug. 11, 2008

(65) Prior Publication Data

US 2009/0308783 A1 Dec. 17, 2009

(51) Int. Cl.
*G09F 1/00* (2006.01)

(52) U.S. Cl. ..... 40/124.03; 40/455

(58) Field of Classification Search ..... 40/124.03, 40/645, 455, 456, 457
See application file for complete search history.

(56) References Cited

U.S. PATENT DOCUMENTS

| | | | | |
|---|---|---|---|---|
| 3,057,093 | A * | 10/1962 | Gallo | 40/645 |
| 5,387,108 | A * | 2/1995 | Crowell | 434/319 |
| 5,860,065 | A * | 1/1999 | Hsu | 704/270 |
| 7,356,154 | B1 * | 4/2008 | Kotzin | 381/334 |
| 2006/0042135 | A1 * | 3/2006 | Hermanson et al. | 40/124.03 |

* cited by examiner

*Primary Examiner* — Gary C Hoge
(74) *Attorney, Agent, or Firm* — Jones Day

(57) ABSTRACT

The present invention discloses a recordable card holder having an electronic record device invisibly perched within a plastic ornament body for supplementing a recording function of a card holder. The present invention discloses a way to personalize gifts of flower bouquets, flow baskets and gift boxes, and thus enhance gift value.

1 Claim, 9 Drawing Sheets

RECORDABLE CARD HOLDER UNIT

BACKGROUND OF THE PRESENT INVENTION

1. Field of Invention

The present invention relates to a card holder that is widely used in the floral industry. And more particularly, it relates to a kind of self-entertaining, handy, small, and convenient decorative ornament which is wearable and serviceable for varying purposes.

2. Description of Related Arts

Nowadays, card holders have been widely used for a variety of purposes. Such card holders are used for flower bouquets/baskets in different celebration occasions like weddings, birthday parties, graduations or funeral services, etc.

However, there are no supplemental functions that have been added into such devices. People probably would discard those card holders afterwards. On the other hand, now more and more, customers want to send the flowers to somebody with personalities or try to create something to show some specialty, such as the sender is just on the scene.

Therefore, it is desirable to develop a kind of decorative entertaining card holder supplemented with the flower sender's voice recording. So when people receive the flower bouquet/basket, the sender's voice will give them a deep joy and they will feel like the sender came in person to share the feelings of happiness or sadness with him or her.

SUMMARY OF THE PRESENT INVENTION

A primary object of the present invention is to provide a new electronic device to record the sound of the gift sender, wherein the card holder is wearable and serviceable so as to provide the user reinforced card holder with an entertainment function.

Another object of the present invention is to provide a self power voice recorder device combined with currently widely used card plastic holders in kind of art deco way, so that the card holder gives people more of a fresh and new outlook instead of like conventional ones.

Another object of the present invention is to provide more enjoyment to the gift receiver. When people receive this new invention, it will give them a deep memory. Even when the flower and bouquet wither, the device still can keep for a long time.

Another object of the present invention is to provide an extendable stick, so that the stick can fit for both the 9" and 18" length needed and also limit the numbers of stock items for the wholesales/retail stores warehouse.

In order to accomplish above mentioned objects, the present invention provides a decorative recordable card holder, comprising: an independent card holder, recordable devices invisibly perched within the card holder body for supplementing a record function and an extensional stick for holding card holder.

These and other objectives, features, and advantages of the present invention will become apparent from the following detail description, and accompanying drawings, and the appended claims.

DETAILED DESCRIPTION OF THE PREFERRED EMBODIMENT

Figure 1:
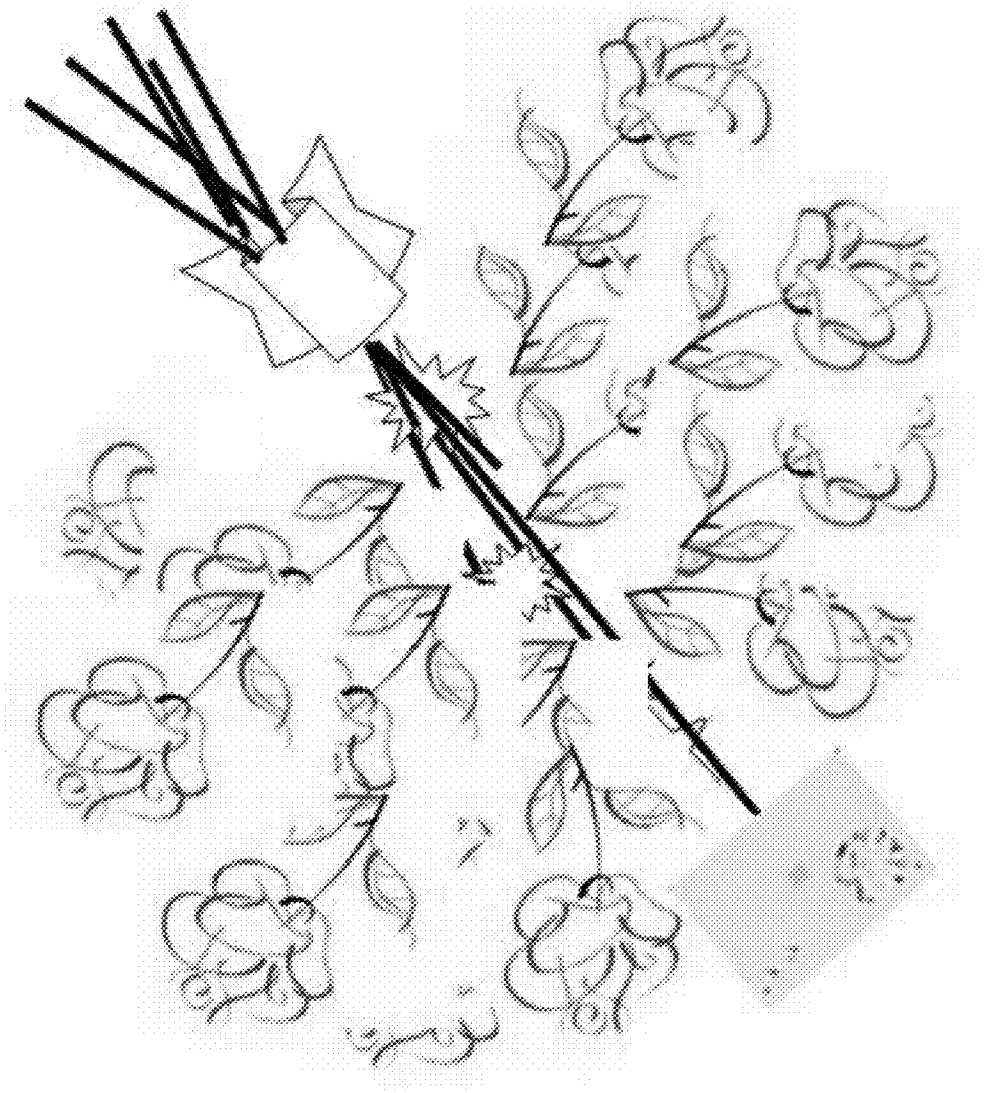
FIG. 1 is perspective view of the recordable card holder unit according to a preferred embodiment of the present invention.
Figure 2:
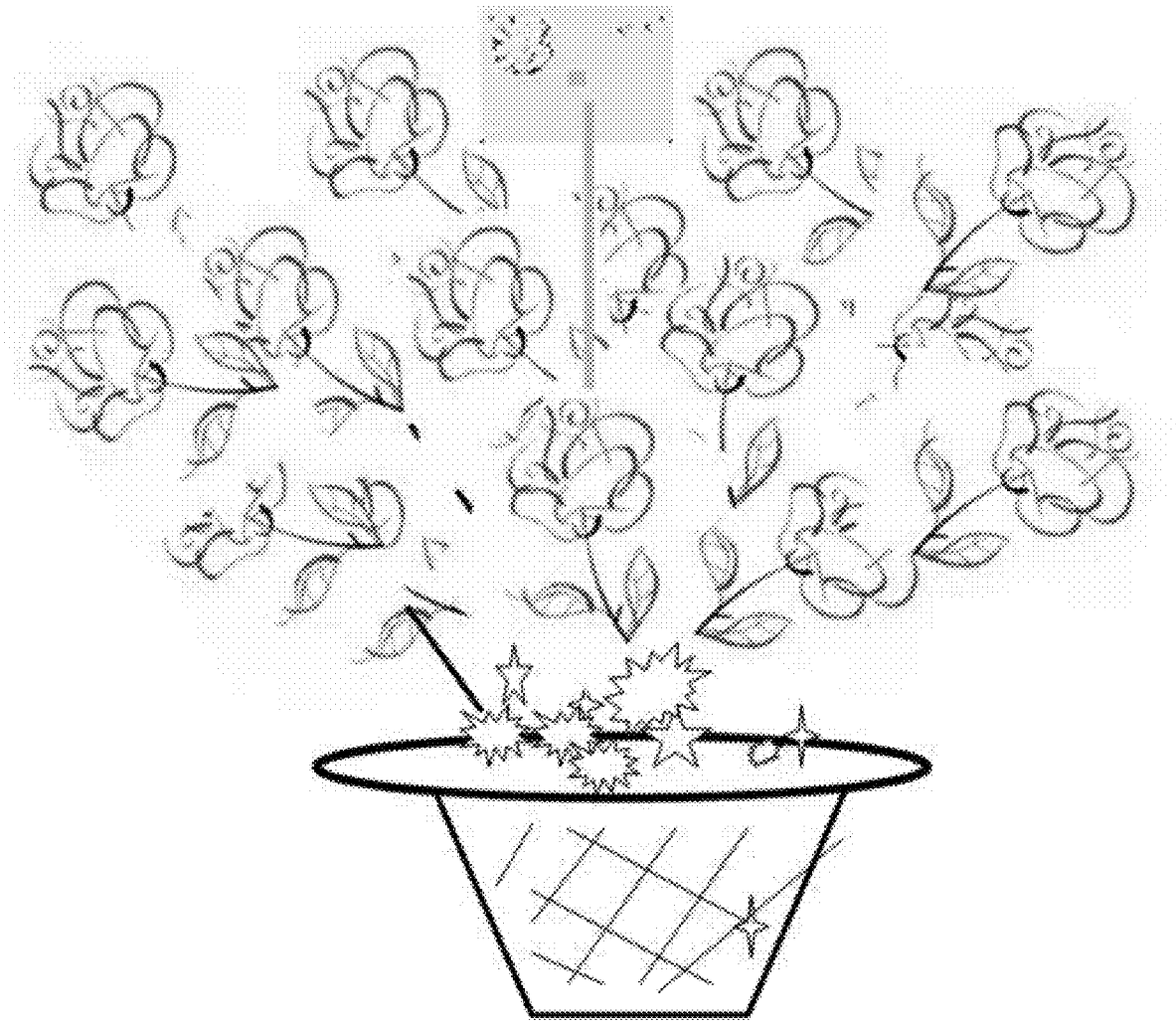
FIG. 2 is a perspective view of the recordable card holder unit according to a preferred embodiment of the present invention.
Figure 3:
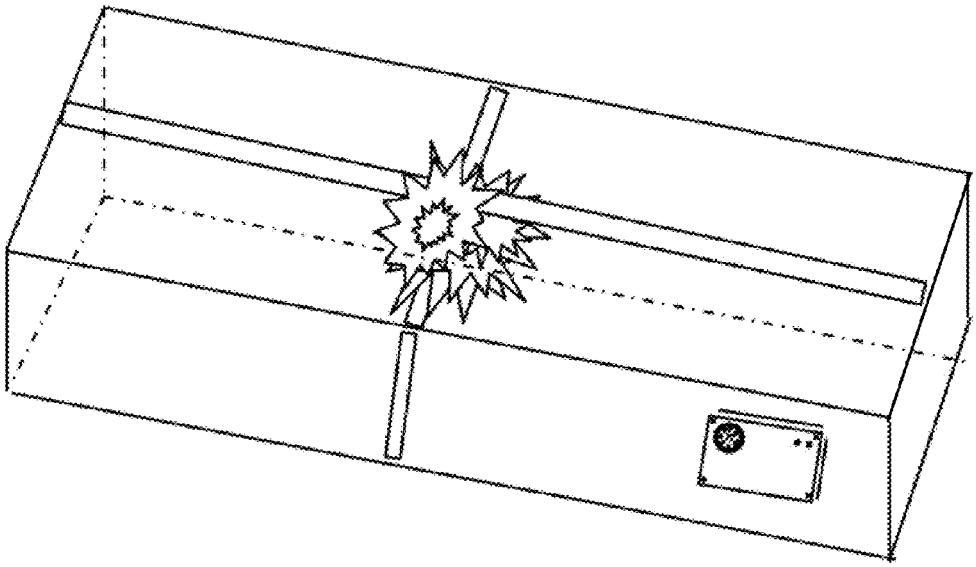
FIG. 3 is a perspective view of the recordable card holder unit according to an embodiment of the present invention.
Figure 4:
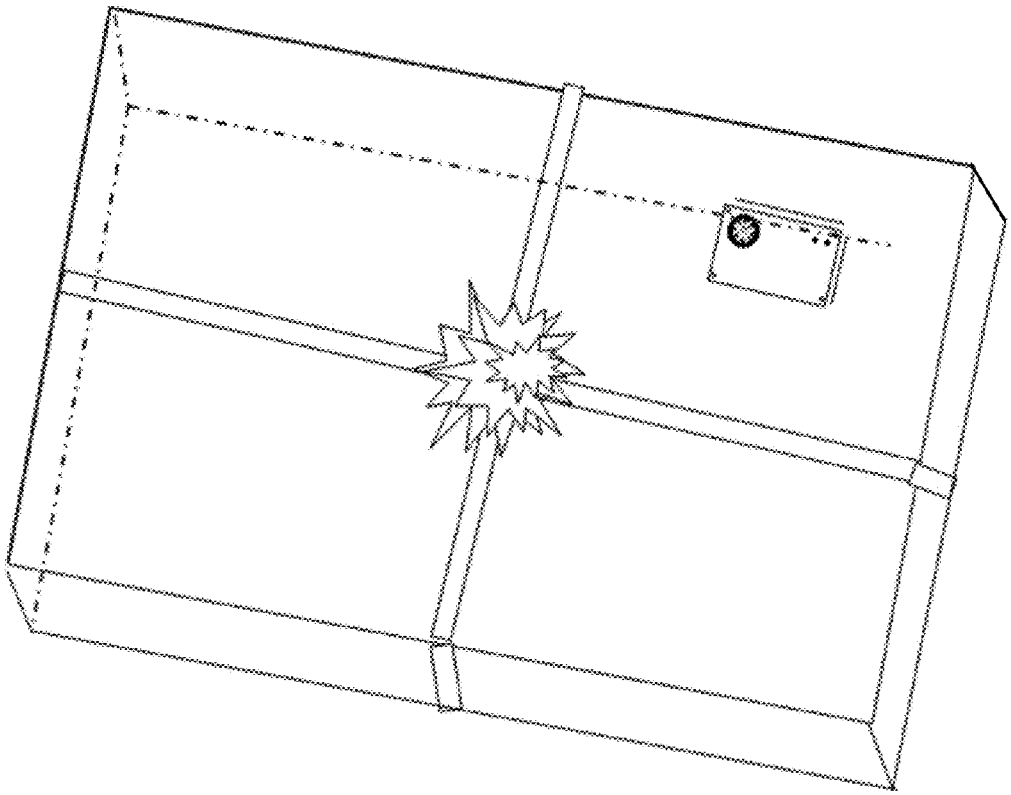
FIG. 4 is a perspective view of the recordable card holder unit according to an embodiment of the present invention.

Referring to FIG. 1 and FIG. 2, a decorative entertaining card holder unit according to the preferred embodiment of the present invention is illustrated. The decorative entertaining card holder unit comprises a base portion of card holder plastic body, and the record device is housed within the plastic body and provides a recording function for the card holder.

In other words, the present invention provides a kind of convenient handy self-recordable device, which is adapted to combine certain functions, such as recording, and erasing and playing record voice and so on into the conventional card holder.

Probably, the present invention is adapted to provide a kind of entertaining service to handy, exquisite, and small decorative items, such as flower bouquets, flower baskets, gift boxes and so on. As shown in FIG. 1, a recordable card holder according to present invention is illustrated. The recordable card holder has a plastic body which houses the recordable device part and uses an extensive plastic stick which can easily screw beneath it to hold the body and combine with the flower stems by a tie of ribbon or it can be stuck anywhere on any kind of gift box, gift basket, bag, photo album and any other kind of gift package whenever there are such kinds of decorative needs/requirements.

Figure 9:
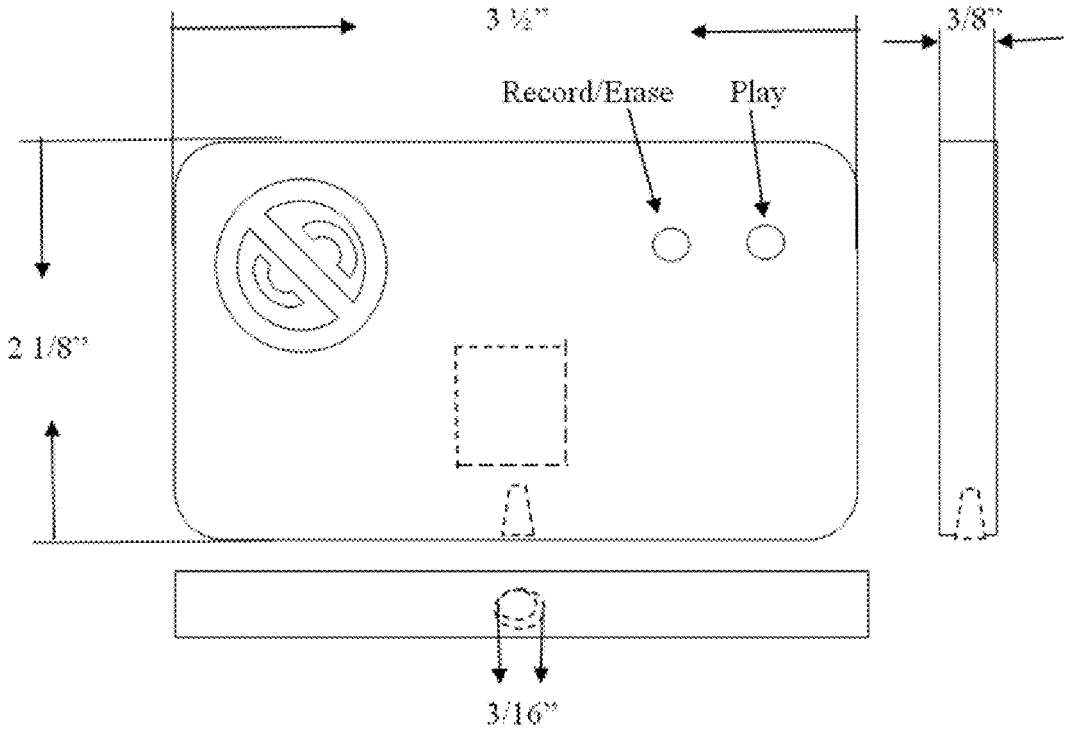
FIG. 9 is a view of the back of the recordable card holder unit according to an embodiment of the present invention.

More importantly, the decorative device of the present invention further comprises two convenient buttons for recording, erasing and playing voice function purposes. As showing FIG. 9, the button is located on the back of the card holder. This allows the user to easily record and they can test and re-record any number of times they want until they are satisfied with their recording.

According to present invention, the recordable card holder comprises a printed circuit board, a power source, two buttons which electronically connect to the printed circuit board for active recording, erase, record, and play sound recording functions.

Also as the recording device part of current invention is powered by three lithium button cell batteries, which can be easily found and replaced. The device changes the traditional way the conventional card holder is used and disposed and can save a lot of plastic material usage and also protect the environment by decreasing waste plastic material disposal.

As shown in FIG. 2, the current invention uses an extensive stick to combine two sizes of conventional card holder to become only one. This could help distributors and retail store warehouses limit their storage item quantities. And also the consumer can take advantage of this one size that can fit two different sizes of the bouquets, baskets, etc. as the current invention encourages the consumer to store and reuse the product many times, and for many circumstances in the future thereby-making the card holder even more economical.

Referring to FIGS. 1-4, a decorative entertaining card holder unit according to the preferred embodiments of the present invention in different events is illustrated.

The decorative entertaining card holder unit comprises a base portion of card holder plastic body, and the recordable device is housed within the plastic body in a nonvisible manner. The recordable device is for supplementing a recording function for pre-recorder background music and flower/gift senders' greeting voice. Both will be played when the flower bouquet/gift box receiver receives them and pushes the "Play" button on the card holder.

Figure 10:
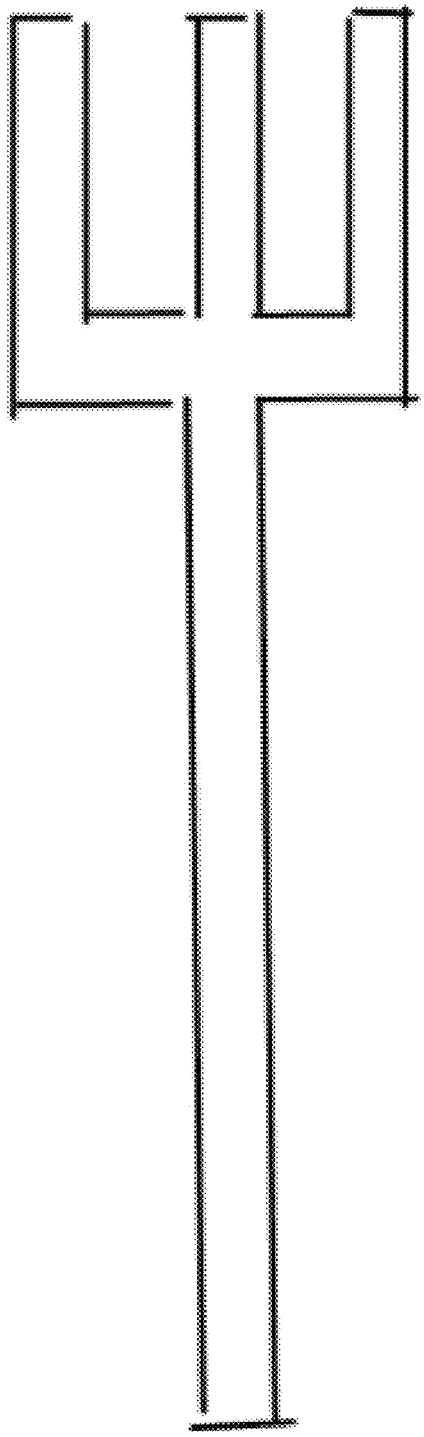
Fig. 10 (Prior Art)
FIG. 10 is a view of a back card in accordance with the prior art.

In other words, the present invention provides a kind of convenient handy self-recordable device, which is adapted to combine with certain functions, such as pre-recorded background music, recording, and erasing and playing recorded flower/gift senders' greeting voice and so on, with a conventional one widely used in currently floral and gift markets which is usually made by three legs forming a flat fork (see FIG. 10).

Figure 5:
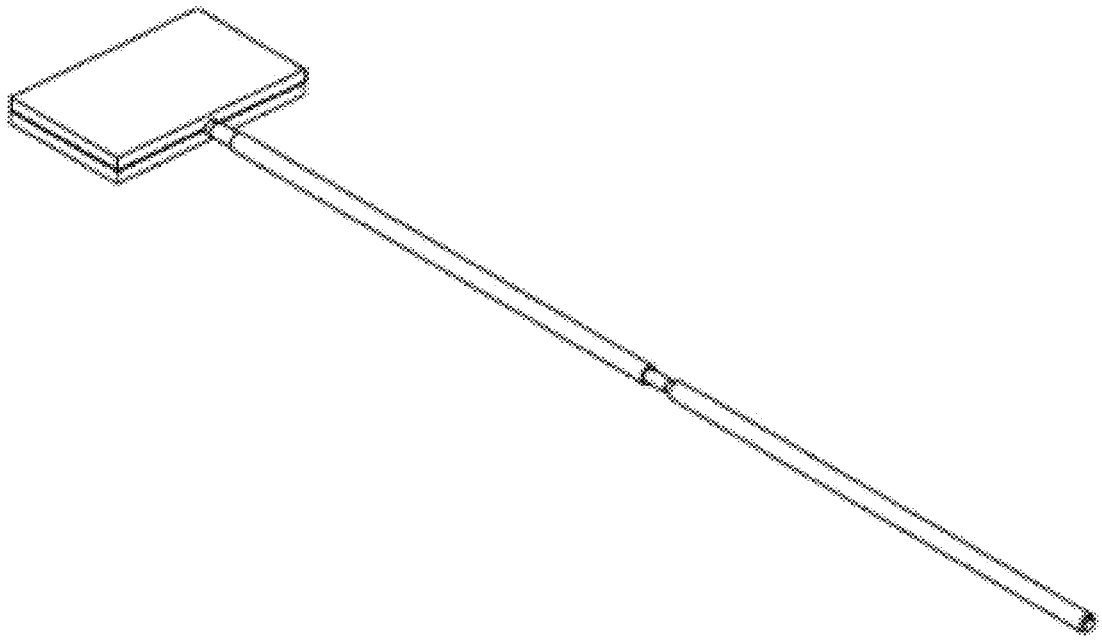
FIG. 5 is a perspective view of the recordable card holder unit according to an embodiment of the present invention.
Figure 6:
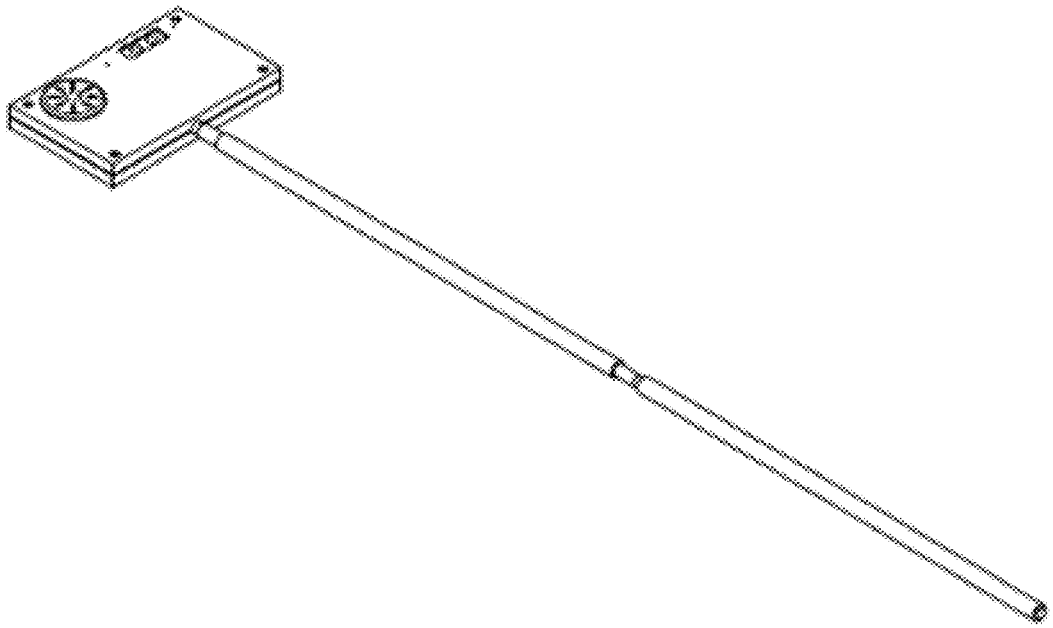
FIG. 6 is a perspective view of the recordable card holder unit according to an embodiment of the present invention.
Figure 7:
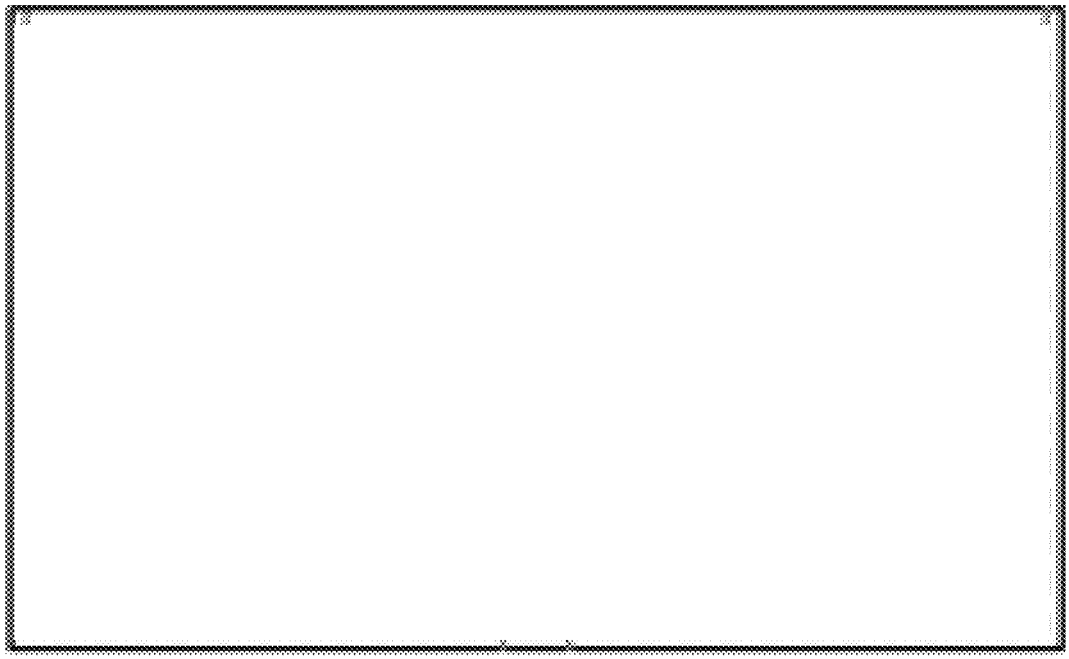
FIG. 7 is a view of the front of the recordable card holder unit according to an embodiment of the present invention.
Figure 8:
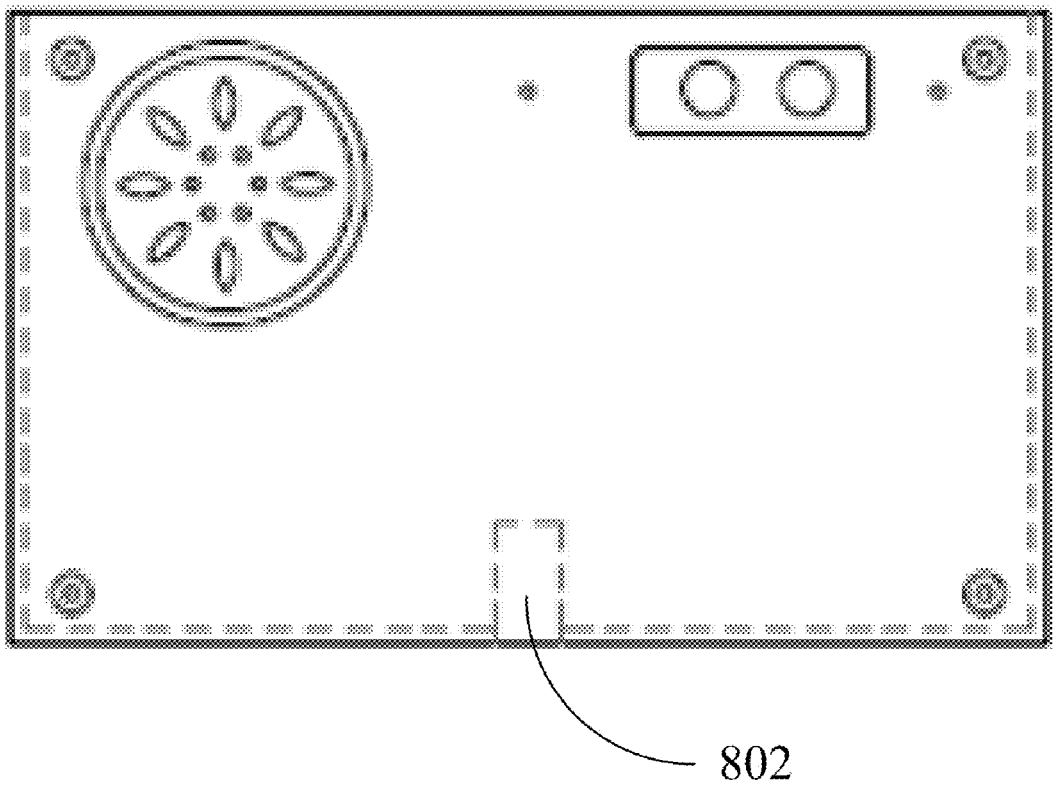
FIG. 8 is a view of the back of the recordable card holder unit according to an embodiment of the present invention.

Probably, the present invention is adapted to provide a kind of entertaining service to handy, exquisite, and decorative gift items, such as flower bouquet, flower basket, gift box and so on. As shown in FIG. 5 and FIG. 6, a recordable card holder according to present invention is illustrated. The recordable card holder has a plastic body which houses the recordable device part and uses an extensive plastic stick which can by easily inserted into the hole beneath it (see FIG. 9) to hold the body and combine with the flower stems of a flower bouquet, basket and gift box, by a tie of ribbon on Style A or it can be stuck anywhere as in Style B which has double sided tape pre-stuck to it (see indent area 802 of FIG. 8) on any kind of gift box, bag, photo album and any other kind of gift package whenever there are such kind of greeting voice record needed/required.

More importantly, the decorative device of the present invention further comprises two convenient buttons for recording, erasing and playing voice function purposes. Especially when and only when people hold the two buttons simultaneously, the greeting voice can be recorded or erased. The buttons are located on right top of back side of the card holder (see FIG. 8). This allows the user to easily record and play and re-record any number of times until they are satisfied with their recording, and they do not have to worry about pushing the wrong button and accidentally erasing their greeting.

According to the present invention, the recordable card holder comprises a printed circuit board, a power source generated from two lithium cell batteries (pre-loaded, and using a "Remove me" label to avoid creepage) which is electronically connected to the printed circuit board for erase, record and play greeting functions. The two lithium cell batteries can be easily found and replaced using a screw driver to open the plastic case. In this way, the device can change the traditional way the card holder is used and can save a lot of plastic and also protect the environment by decreasing the amount of waste plastic material disposed.

One skilled in the art will understand that the embodiment of the present invention as shown in the drawing and described above is exemplary only and not intend to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of my claims.

What is claimed is:

1. A recordable card holder for use with a gift, the recordable card holder having a decorative function and a recorded greeting function, the recordable card holder comprising:

a plastic ornamental body including an indented section;

an electronic recording device non-visibly housed within said plastic body, the electronic recording device comprising means for recording a message, means for erasing the message, means for re-recording the message, means for playing the message, a printed circuit board, a user-replaceable battery power source, and pre-recorded background music configured to be played simultaneously with the message;

two buttons on the recording device, configured to be pressed simultaneously to re-record messages;

an extendable stick that includes three prongs for holding the ornamental body;

a ribbon that combines the stick with flower stems; and double-sided tape adhered to the indented area for adhering the body to a gift box.

* * * * *